United States Patent [19]

Eastcott et al.

[11] 4,108,280

[45] Aug. 22, 1978

[54] PLURAL ROPE FRICTION HOIST WITH BRAKING APPARATUS

[75] Inventors: Peter DeH. Eastcott; Peter T. Truman, both of Peterborough, Canada

[73] Assignee: Canadian General Electric Company, Ltd., Toronto, Canada

[21] Appl. No.: 754,188

[22] Filed: Dec. 27, 1976

[30] Foreign Application Priority Data

Feb. 13, 1976 [CA] Canada ..... 245657

[51] Int. Cl.[2] ..... B66B 11/08

[52] U.S. Cl. ..... 187/20; 187/71; 188/71.5; 188/72.5

[58] Field of Search ..... 187/20, 71, 73; 188/71.5, 72.4, 72.5, 73.3

[56] References Cited

U.S. PATENT DOCUMENTS

| | | | |
|---|---|---|---|
| 1,029,627 | 6/1912 | Pearson | 187/20 |
| 3,332,665 | 7/1967 | Bruns | 187/20 |
| 3,645,519 | 2/1972 | Schwarz | 187/71 |

FOREIGN PATENT DOCUMENTS

| | | | |
|---|---|---|---|
| 921,838 | 2/1973 | Canada | 188/72.5 |
| 2,333,120 | 1/1975 | Fed. Rep. of Germany | 187/20 |

*Primary Examiner*—Evon C. Blunk
*Assistant Examiner*—Jeffrey V. Nase
*Attorney, Agent, or Firm*—Arnold E. Renner

[57] ABSTRACT

A friction hoist having at least two friction wheels each carrying a rope supporting a counterbalanced conveyance includes a motor to rotationally drive at least one of the wheels. The wheels are mounted for independent rotation on a common shaft and are permitted limited axial motion with respect to one another. A braking apparatus is provided for engagement with outer faces of the wheels while opposed inner faces of adjacent wheels are provided with a braking material such that actuation of the braking apparatus forces the wheels together and the wheels are braked as a unitary structure.

3 Claims, 4 Drawing Figures

PLURAL ROPE FRICTION HOIST WITH BRAKING APPARATUS

BACKGROUND OF THE INVENTION

The present invention relates generally to friction hoists and more particularly to a multiple rope friction hoist having at least two wheels mounted on a common axis.

Essentially, a friction hoist is a large diameter wheel around which one or more ropes, for example steel cables, are looped half a turn so that they hang down a hoist shaft, for example a mine hoist shaft, for supporting a pair of conveyances which tend to counterbalance one another. Rotation of the wheel drives the rope or ropes in the manner of a belt on a pulley causing one conveyance to be raised while the other is lowered. The direction of wheel rotation is reversible so that either conveyance can be raised or lowered as required. It is, of course, known to have a system with one conveyance and a counterbalancing weight rather than two conveyances.

The conventional wheel is a large diameter, wide rim, single structure, fixed to a shaft and supported by outboard bearings for rotation on a horizontal axis. The periphery or rim of the wheel has treads which form a groove in which the rope runs and defines a tread wear path. There is, of course, a groove for each rope on the wheel. The tread is usually of a tough, wear resistant material, for example plastic or leather, to provide a good frictional grip on the rope.

The operation of friction hoists, particularly in a mine hoist where the distances for raising and lowering are large, is usually under conditions of considerable acceleration and deceleration which impose severe loading on the ropes. In addition, a mine hoist may have its conveyances loaded and unloaded very quickly, for example by dumping, which may also cause strain on the ropes. In larger installations a plurality of ropes are often used on a friction wheel to provide a safety factor. In this situation, the breaking of one rope will not result in the falling of a conveyance because the remaining rope or ropes are designed to support the load. In some installations it is technically feasible to use a single rope, but safety considerations may dictate otherwise. With a single rope installation, emergency braking means must be provided on the conveyance to engage the wall of the shaft and stop the conveyance if the rope were to break. This type of emergency braking has not been entirely satisfactory in the past and it may not be acceptable where the conveyances are intended to convey people.

As previously mentioned, one alternative to a single rope hoist is to provide plural ropes on the friction wheel to support the conveyances. The ropes are chosen by design so that less than the full number can support the load during emergency conditions if one rope should fail. However, considerable problems are involved in going from a single rope to a plural rope system. For example, in a system having two ropes on the wheel of a friction hoist, the load should be shared equally between the ropes. This is possible, in theory, if both tread wear paths are identically covered and of equal diameters, if both treads wear at exactly the same rate, if wheel deflection affects the treads for both ropes in the same manner, and if both ropes lengthen or shorten in synchronism to the same extent with changes in loading. Obviously, these conditions are not easily met and, consequently, it is difficult to maintain good load sharing between the ropes of a multi-rope winder under all practical hoisting conditions.

Devices for equalizing rope tension are known. These devices are usually mechanical or fluid actuated devices which are difficult to maintain and have inherent limitations. Experience has shown that this is not an entirely satisfactory solution in practice. The ropes tend to behave individually on a wheel that is single unit by winding at slightly different rates. These different winding rates can cause intermittent differences of significant magnitude in the loading of the ropes. As hoists become larger and faster the problems in rope loading increase and may present a limitation on the use of, for example, a friction mine hoist. It is important to ensure that the safe stress level on a rope is not exceeded, and the prior devices cannot always ensure this particularly on large installations.

In a copending U.S. patent application, Ser. No. 754,187, "Unit Hoist," by Peter deHertel Eastcott filed on even date herewith and assigned to the assignee of the present invention, there is described and claimed an arrangement for a friction hoist with two or more ropes in which rope tension is equalized. That invention employs a unit concept where each rope has a separate friction wheel driven by its own motor and a separate braking means. That is, each rope has associated with it a drive motor, wheel and brake to form a unit. The motors are connected electrically to control their driving forces to provide equal incremental rope tensions. The braking means for each wheel in interconnected to provide equal braking. It is essential that both the drive and the braking forces be equalized among the ropes. The arrangement may be used with two or more ropes, and it is particularly suitable for more than two ropes. For an installation where a single rope is adequate, but two ropes are required for reasons of safety, the expense of a separate drive motor for each rope and wheel and of a separate braking system for each rope and wheel, with an equalizing control may not be attractive.

SUMMARY OF THE INVENTION

It is, therefore, an object of the present invention to provide an improved plural rope hoist.

It is a further object to provide a plural rope hoist having a common brake system.

It is another object to provide a plural rope hoist having at least one driven and one idler wheel mounted on a common shaft with a common brake means to effect braking on both wheels.

It is a still further object to provide a plural rope hoist drive and brake system including at least one driven and one idler wheel with a common brake system.

The foregoing and other objects are achieved, in accordance with a preferred embodiment of the present invention, by providing at least two friction wheels on a common shaft. A first wheel, a driven wheel, is fixed to the shaft and is rotated by the shaft. The other wheel, an idler wheel, is mounted on the shaft, adjacent the driven wheel, and it is free to rotate on the shaft. One rope passes over each wheel and both ropes are connected to the conveyances in the usual manner. Because only one wheel is driven, both wheels share equally in supporting the dead weight, but differential tension due to winding inequalities can occur. For example, during acceleration and deceleration there will be a difference in rope tension because one wheel is driven and the other is not. However, these differences in rope tension are relatively small and do not affect wear greatly. The rope tensions will equalize at rest so there will be no accumulation of tension difference with wear. The braking arrangement gives a type of automatic equalization. The driven wheel and the idler wheel are adjacent one another and braking material is located between them. This material, which may be referred to as the first friction material, may be carried or supported by either wheel as described. A braking device is provided at each side, that is one device is provided at the outer wheel face of the driven wheel and another is provided at the outer wheel face of the idler wheel. These braking devices are provided with a braking material which may be referred to as the second friction material. Actuation of the braking devices presses the two braking devices towards one another which in turn forces the idler wheel and the driven wheel together. Thus, during braking action, a braking force is provided against the outer face of each wheel and the wheels are pressed together with the braking material between them which tends to lock the wheels together. Thus, if one rope should break there is a second rope to support the conveyances, and when the brakes are applied the braking forces from both wheels are available to stop the wheels and the remaining rope.

It will be seen that this braking arrangement also can be used in another embodiment of the invention in which there are two separately driven wheels on a common shaft. One or more idler wheels may also be mounted on the shaft. It will also be seen that this braking arrangement is preferable to having individual and separate braking on each wheel because if a rope breaks in a system having separate braking on each wheel, then the braking surfaces and braking action of only the wheels with good ropes are available to brake the good rope. In the braking system of the present invention, if a rope should break, the braking surfaces of all wheels are available to brake the wheel carrying the good rope(s), and the total braking on the suspended mechanical system remains unchanged.

BRIEF DESCRIPTION OF THE DRAWING

While the present invention is described in particularity in the claims annexed to and forming a part of this specification, a better understanding thereof can be had by reference to the following description taken in conjunction with the accompanying drawing in which:

DETAILED DESCRIPTION

Figure 1:
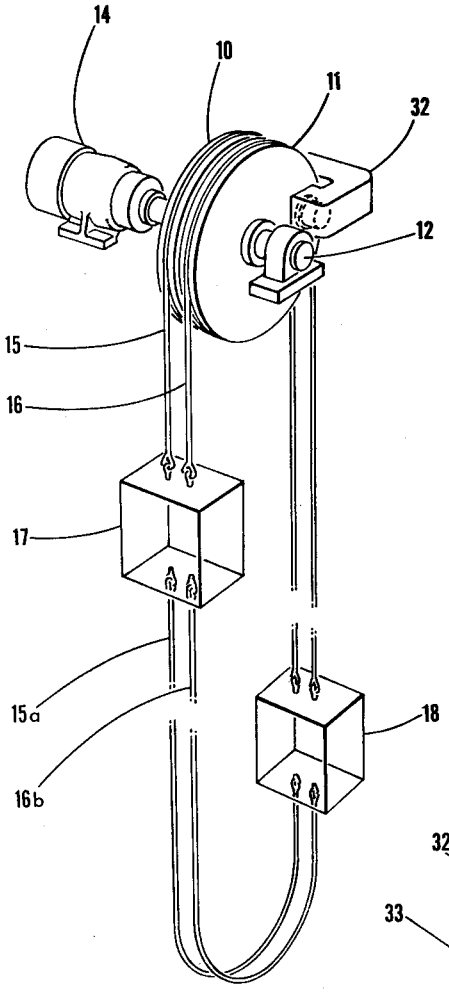
FIG. 1 is a schematic isometric view of a friction hoist having two ropes.

Referring to FIG. 1, there is shown in schematic form a mine hoist having two friction wheels 10 and 11 mounted on a common shaft 12. Wheel 10 may represent a driven wheel, driven by a motor 14, and the wheel 11 may represent an idler wheel mounted on bearings (not shown in FIG. 1) for rotation with respect to shaft 12. A first rope (e.g., a steel cable) 15 is looped over wheel 10 and a second rope 16 is looped over wheel 11. Ropes 15 and 16 (termed "head ropes") are connected to conveyances 17 and 18, as shown, so that they may be raised and lowered by rotation of friction wheels 10 and 11. The ropes 15 and 16 connected to the tops of conveyances 17 and 18 continue, as ropes **15*a* and 16*a* to interconnect the bottoms of the two conveyances. Ropes 15*a* and 16*a*** are called "balance ropes" and they serve to balance out the weight of the head ropes. Thus, FIG. 1 shows the general arrangement of a friction hoist with a driven wheel and an idler wheel, as it might be used in a mine hoist.

Figure 2:
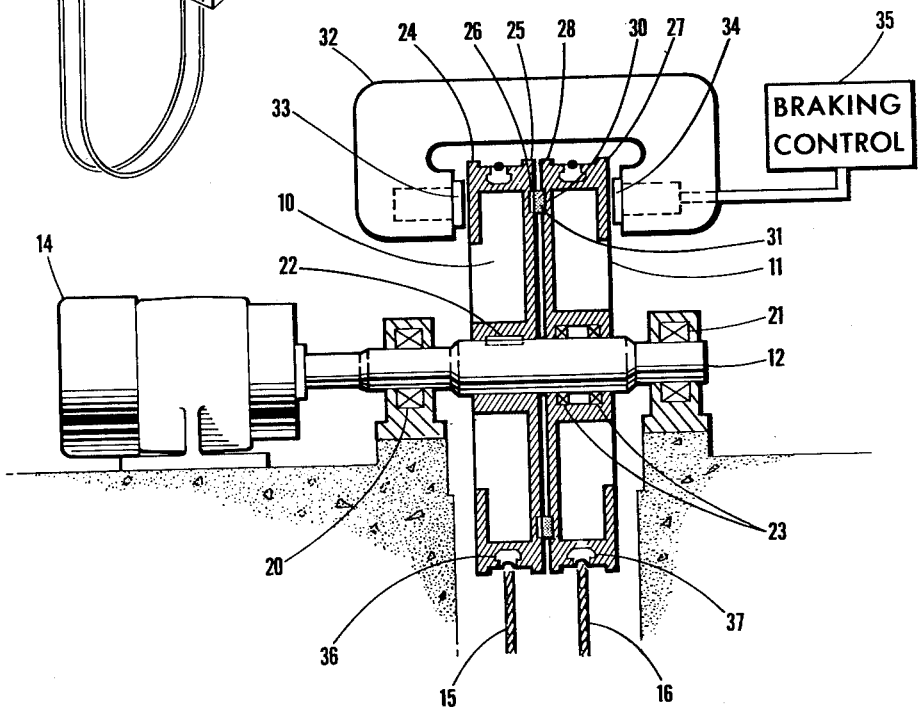
FIG. 2 is an elevation of the wheels of a friction hoist showing the invention in one form.

Referring now to FIG. 2, the two friction wheels 10 and 11 are shown in more detail. The wheels are mounted on a common shaft 12 which is supported horizontally for rotation in bearings 20 and 21. Shaft 12, as shown, is driven directly by an electric motor 14. Wheel 10 is keyed to shaft 12 as indicated at 22, and rotates with shaft 12. Wheel 11 is mounted on bearings 23 so that wheel 11 can rotate independently of shaft 12. Wheel 11 is permitted to have a limited degree of lateral movement as will be referred to hereinafter. Wheel 10 has an outer face 24, that is an outwardly facing part of the wheel rim which serves as a braking surface and an inner side (inner being used to indicate it is adjacent wheel 11 rather than on the side remote from wheel 11) with a rim portion 25 having a shallow braking groove 26. Similarly wheel 11 has an outer face 27 of the wheel rim which serves as a braking surface and an inner side with a rim portion 28 having a shallow groove 30. An annular ring 31 of material suitable for brake lining is mounted in groove 30 so that it projects beyond the surface of rim portion 28. The projecting portion of ring 31 is smaller in its respective radial dimensions than the radial dimensions of groove 26 and it is received in groove 26. Thus, groove 26 provides a recessed braking surface which tends to be protected to some extent from foreign material. If wheel 11 is urged towards wheel 10, the ring 31 of braking material will engage the bottom surface of groove 26 to provide a braking action with respect to motion between the two wheels 10 and 11. The braking material 31 is, of course, thick enough to provide braking without the rim portions making contact with one another. It is to be expressly understood that the ring 31 and groove 26 could be interchanged with respect to wheels 10 and 11 and that other configurations could be employed without departing from the broader concept of that there illustrated.

A generally U-shaped main braking means or braking assembly 32 has two moveable disc-like elements 33 and 34. The brake element 33 is mounted in braking member 32 so that it can be moved outwardly to engage rim face 24 or can be retracted to be clear of rim face 24. Similarly, brake element 34 is mounted in braking member 32 so that it can be moved outwardly to engage rim face 27 and can be retracted to clear rim face 27. A brake control 35 is provided to cause the braking elements 33 and 34 to move outwardly at the same time and to be withdrawn or retracted at the same time. It is believed mechanisms and arrangements for causing brake elements to move in unison are well known and no further description of means for doing this is required.

It will be seen that as the brakes are applied, that is as brake elements 33 and 34 move outwardly from the member 32 in response to brake control 35, the idler wheel 11 is urged laterally (i.e., axially) towards wheel 10 by brake element 34. Wheel 11 is mounted for limited lateral movement as was previously mentioned. This brings braking material 31 into engagement with the surface of braking groove 26 and tends to lock wheels 10 and 11 together. Further outward movement of brake elements 33 and 34 will brake wheels 10 and 11 simultaneously.

Wheels 10 and 11 have treads 36 and 37, respectively, which have grooves carrying ropes 15 and 16, respectively. It will be seen that in the event one of ropes 15 or 16 breaks, any braking action will lock wheels 10 and 11 together and the braking forces will be applied to both wheels 10 and 11 simultaneously. Because the wheels are locked together, the frictional forces from both wheels 10 and 11 are available to slow and stop the wheel that is supporting the load, that is the wheel carrying the unbroken rope.

Figure 3:
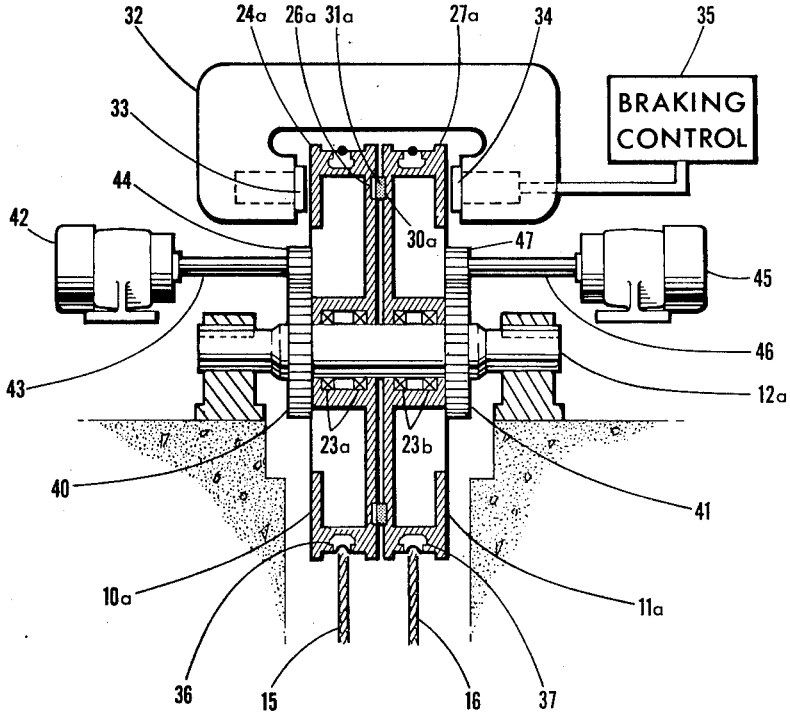
FIG. 3 is an elevation showing the invention in another form.

FIG. 3 shows a second embodiment of the invention in which there are two friction wheels and both are driven. The friction wheels are shown as 10*a* and 11*a* both mounted on a horizontal fixed shaft 12*a*. Wheel 10*a* is provided with bearings 23*a* and wheel 11*a* is provided with bearings 23*b* so that both wheels 10*a* and 11*a* are free to rotate on shaft 12*a*. Both wheels 10*a* and 11*a* are mounted to permit limited lateral movement. The wheel 10*a* has treads 36 which carry rope 15 and wheel 11*a* has treads 37 which carry rope 16 as before.

In FIG. 3, a wheel 10*a* has mounted on it a toothed wheel or gear wheel 40 and wheel 11*a* has mounted on it a toothed wheel or gear wheel 41. Both the gear wheels 40 and 41 are coaxial with wheels 10*a* and 11*a* and are fastened to the respective wheel. A motor 42 drives a shaft 43 connected to a gear wheel or pinion 44 which is in engagement with toothed wheel or gear wheel 40. Similarly a motor 45 drives a shaft 46 connected to a gear wheel or pinion 47 which is in engagement with toothed wheel or gear wheel 41. Thus motors 42 and 45 provide the drive for friction wheels 10*a* and 11*a*, respectively.

The braking arrangement shown in FIG. 3 is identical to that in FIG. 2. A main braking member 32 has disc-like braking elements 33 and 34. The braking element 33 is arranged to engage the outer rim face 24*a* of wheel 10*a* and the braking element 34 is arranged to engage the outer rim face 27*a* of wheel 11*a*. A braking control 35 moves braking elements outwardly to engage rim faces 24*a* and 27*a* or retracts the elements 33 and 34. Braking control 35 may conveniently provide for fluid actuation of elements 33 and 34 or for a combination of spring actuation and fluid actuated release. The wheel 10*a* has a groove 26*a* and wheel 11*a* has a groove 30*a* which has mounted in it a ring 31*a* of braking material. The material 31*a* projects past the inner surface of wheel 11*a* to engage the facing surface of groove 26*a* as wheels 10*a* and 11*a* are moved together. It will be seen that the braking of wheels 10*a* and 11*a* of FIG. 3 is the same as that for wheels 10 and 11 of FIG. 2.

The aforementioned copending U.S. patent application Ser. No. 754,187 describes means for equalizing tension in ropes during raising and lowering where each rope engages a separate friction wheel driven by a separate motor in which the motor armatures are connected in series and the fields are set or controlled to provide equal driving tension. A similar arrangement would be used for interconnecting the motors of FIG. 3 to provide equal rope tension during operation. The copending application describes a braking means which is not used in the present invention. The braking means of the present invention provides advantages when used with two friction wheels as in the embodiments described.

Figure 4:
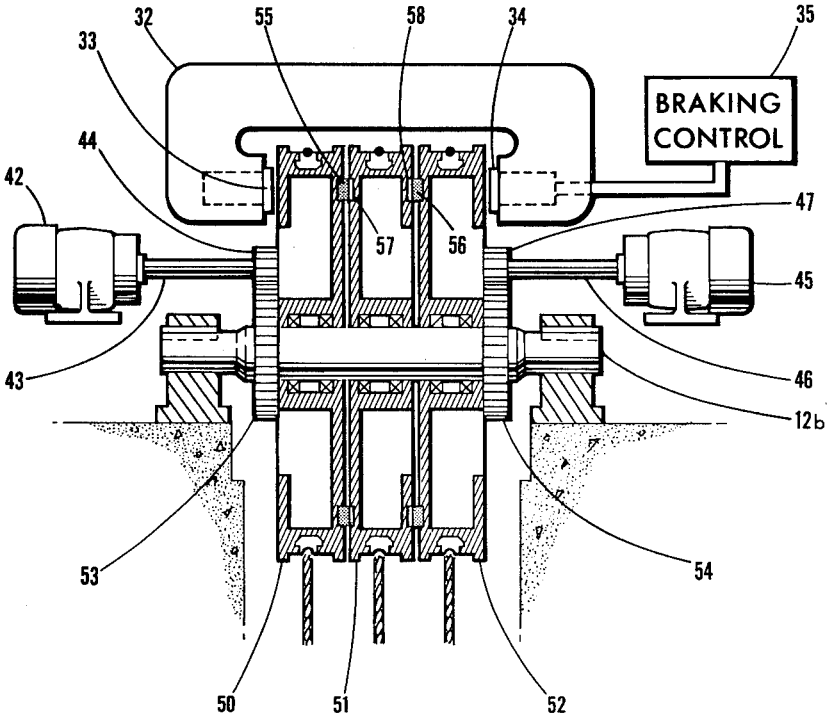
FIG. 4 is an elevation showing the invention in yet another form.

Referring now to FIG. 4, there is shown an additional embodiment of the invention having two driven wheels and one idler wheel mounted between the driven wheels. The braking system is the same as described in connection with FIG. 1 and FIG. 2 where a main braking member 32 has arm portions extending adjacent the outer faces of the outer wheels with discs of braking material 33 and 34 carried in the arm portions to move outwardly and inwardly to apply and release the brakes as is known in the art.

In FIG. 4 the wheels, shown at 50, 51 and 52, are respectively supported on bearings 23*c*, 23*d* and 23*e* for rotation on a shaft 12*b*. Wheel 50 has a gear wheel 53 fixed to its outer face around the shaft 12*b*. A pinion 44 engages gear wheel 53, and a motor 42 drives shaft 43 with pinion 44 to drive friction wheel 50. Wheel 52 has a gear wheel 54 fixed to its outer face and this is engaged by a pinion 47. A motor 45 has a shaft 46 which drives pinion 47 and thus drives friction wheel 52. Friction wheel 51 is an idler wheel. The inner faces of wheels 50 and 52 have mounted thereon a ring of friction material or braking material 55 and 56, respectively. This may be mounted on a flat surface of the wheel or in a recess as shown and as described for FIGS. 2 and 3. A braking groove 57 and 58 may be provided in either side of idler wheel 51 to receive the braking material 55 and 56, respectively. The grooves 57 and 58 are not essential, but may be used to provide a machined braking surface and to afford some protection from foreign material.

It is believed that the operation of the apparatus of FIG. 4 will be apparent. The two friction wheels 50 and 52 are driven by motors 42 and 45 in the same manner as wheels 10*a* and 11*a* of FIG. 3 are driven. When the braking control 35 is actuated to apply the brakes, the discs 33 and 34 of braking material move towards one another to engage the respective faces of wheels 50 and 52. Wheels 50 and 52 are moved towards one another so that braking material 55 and 56 engage a respective face of wheel 51 tending to lock all three wheels together as well as to apply a braking face to the outer faces of wheels 50 and 52. This will brake all three ropes supported by the three wheels. The total braking face on the suspended mechanical system will be available, even if one rope breaks.

While there have been shown and described what are at present considered to be the preferred embodiments of the invention, modifications thereto will readily occur to those skilled in the art. For example, while no embodiment shown includes more than one idler wheel, more than one could be utilized if desired. Drive systems of the types other than those shown could also be used. In addition, while the braking material between adjacent wheels is shown, in all instances, as being carried by one of the wheels, this material could be supported by an independent support such as freely rotating disc mounted on the same shaft as supports the friction wheels. It is not desired, therefore, that the invention be limited to the specific embodiments shown and described and it is intended to cover, in the appended claims, all such modifications as fall within the true spirit and scope of the invention.

What is claimed is:

1. A friction hoist comprising:

(a) at least two friction wheels each having a rim portion on a side thereof facing an adjacent wheel and an outwardly directed rim face on the side not facing an adjacent wheel;

(b) means including a common fixed shaft for supporting the friction wheels coaxially with one another and adjacent one another for rotation independently of one another, said friction wheels being arranged for limited axial movement with respect to one another;

(c) a rope looped over each friction wheel and having frictional engagement therewith;

(d) conveyance means suspended by the ropes;

(e) first and second motor means for driving, respectively, said first and second friction wheels for rotating the wheel to raise and lower the conveyance means;

(f) first braking material between said facing rim portions to provide braking with respect to relative movement between adjacent wheels when they are urged together;

(g) braking means having a second braking material for braking engagement with said outwardly directed rim faces; and, (h) braking control means for actuating said braking means to cause movement of said second braking material into and out of braking engagement with said outwardly directed rim faces, movement of said second braking material into braking engagement with said outwardly directed rim faces applying a braking force to the friction wheels they engage and urging said friction wheels together for engagement with said first braking material.

2. A friction hoist comprising:

(a) a horizontally supported shaft mounted for rotation in supporting bearings;

(b) first and second friction wheels mounted adjacent one another one said shaft for independent rotation, said first friction wheel being keyed to said shaft and said second friction wheel being mounted on said shaft on bearings for rotation about said shaft, at least said second friction wheel also being mounted for limited movement in an axial direction;

(c) a rope looped over each friction wheel and having frictional engagement therewith;

(d) conveyance means suspended by the ropes;

(e) a motor connected to said shaft to form a driving connection with said first friction wheel for rotating said first friction wheel to raise and lower said conveyance means;

(f) said first and second friction wheels each having a rim portion on adjacent facing sides, each of said rim portions including an annular groove opposite the groove of the other rim portion;

(g) first braking material mounted in a one of said grooves, projecting beyond the surface of the rim portion adjacent said groove and adapted to be received by the other of said grooves which forms a recessed braking surface for engagement with said braking material to thereby provide braking with respect to relative movement between said first and second friction wheels when one friction wheel is urged towards the other;

(h) said first and second friction wheels each having an outwardly directed rim face;

(i) a braking assembly having a first arm adjacent the outwardly directed rim face of said first friction wheel and a second arm adjacent the outwardly directed rim face of said second friction wheel;

(j) a first and a second braking device on said first and second arms, respectively, each having a second braking material for braking engagement with the respective outwardly directed rim face; and, (k) braking control means for actuating said first and second braking devices to cause movement of said second braking material of each braking device into and out of braking engagement with the respective ones of said outwardly directed rim faces, movement of said second braking material into braking engagement with the respective outwardly directed rim face applying a braking force to said first and second friction wheels to thereby urge the friction wheels together.

3. A friction hoist comprising:

(a) a horizontally supported shaft;

(b) first and second friction wheels mounted on said shaft on bearings for independent rotation, at least said second friction wheel being mounted for limited movement in an axial direction;

(c) a rope looped over each friction wheel having frictional engagement therewith;

(d) conveyance means suspended by the ropes;

(e) first and second motors having, respectively, driving connections with said first and second friction wheels for rotating said friction wheels to raise and lower said conveyance means, each of said driving connections including a first gear wheel fixed to the outward side of the respective friction wheel and a second gear wheel fixed to the shaft of the respective motor and being in driving engagement with its associated first gear wheel;

(f) said first and second friction wheels each having a rim portion on adjacent facing sides;

(g) first braking material between said facing rim portions for engagement with said facing rim portions to provide braking with respect to relative movement between said first and second friction wheels when one friction wheel is urged towards the other;

(h) said first and second friction wheels each having an outwardly directed rim face;

(i) a braking assembly having a first arm adjacent the outwardly directed rim face of said first friction wheel and a second arm adjacent the outwardly directed rim face of said second friction wheel;

(j) a first and a second braking device on said first and second arms, respectively, each having a second braking material for braking engagement with the respective outwardly directed rim face; and, (k) braking control means for actuating said first and second braking devices to cause movement of said second braking material of each braking device into and out of braking engagement with the respective ones of said outwardly directed rim faces, movement of said second braking material into braking engagement with the respective outwardly directed rim face applying a braking force to said first and second friction wheels and pressing said rim portions of said first and second friction wheels into engagement with said first braking material.

* * * * *